United States Patent [19]

Manhardt et al.

[11] Patent Number: 4,844,344

[45] Date of Patent: Jul. 4, 1989

[54] FLOW RATE LIMITING DEVICE FOR FUEL DISPENSING NOZZLES

[76] Inventors: Paul D. Manhardt, 1008 Tokalon Dr., Knoxville, Tenn. 37922; Leonard R. Nitzberg, 1413 Buckeye La., Knoxville, Tenn. 37919

[21] Appl. No.: 165,756

[22] Filed: Mar. 9, 1988

[51] Int. Cl.[4] ..... B05B 1/30; B67D 5/377

[52] U.S. Cl. ..... 239/590; 239/590.3; 239/590.5; 222/547; 222/564; 138/40

[58] Field of Search ..... 239/589, 590, 590.3, 239/590.5, 592, 594, 463, 466, 482, 483; 222/544, 547, 564; 141/206, 207, 208; 138/40–46; 406/83, 86, 92, 191, 195

[56] References Cited

U.S. PATENT DOCUMENTS

| | | | |
|---|---|---|---|
| 1,176,935 | 3/1916 | Walden et al. | 239/590 |
| 2,478,998 | 8/1949 | Boyd et al. | 138/40 |
| 2,562,930 | 8/1951 | Mapes | 239/590 |
| 2,602,701 | 7/1952 | Walter | 239/461 |
| 3,154,132 | 10/1964 | Mazzeo | 239/590 |
| 3,749,130 | 7/1973 | Howitt et al. | 138/42 |
| 3,964,875 | 6/1976 | Chang et al. | 138/42 |
| 4,213,488 | 7/1980 | Pyle | 141/207 |

*Primary Examiner*—Andres Kashnikow
*Assistant Examiner*—Karen B. Merritt
*Attorney, Agent, or Firm*—Alan Ruderman

[57] ABSTRACT

A flow rate limiting device (24) for a dispensing nozzle (10) having an inlet (12) through which fuel is supplied to the nozzle (10) from a supply hose, an outlet (18) from which fuel is discharged, and an internal flow passage (14) along which fuel flows from the inlet (12) to the outlet (18). The flow rate limiting device (24) comprises turbulence generating means (26) mounted in the nozzle (10) within the internal flow passage (14) for generating a turbulence in the fuel flow, whereby such turbulence decelerates the flow of fuel through the passage (14).

12 Claims, 2 Drawing Sheets

FLOW RATE LIMITING DEVICE FOR FUEL DISPENSING NOZZLES

TECHNICAL FIELD

This invention relates to fuel dispensing nozzles, and more particularly concerns a device for limiting the rate of flow of fuel through a fuel dispensing nozzle such that it is prevented from exceeding a preselected threshold flow rate.

BACKGROUND ART

Fuel dispensing nozzles are commonly used to dispense gasoline or other fuels into fuel tanks of motorized vehicles. Conventional dispensing nozzles include a nozzle body defining an internal flow passage extending between the nozzle inlet and its outlet. The inlet of the nozzle is connected to a supply hose which feeds pressurized gasoline or other fuel to the nozzle. This pressurized fuel passes through the internal flow passage to an outlet which consists of, or is connected to, a spout which serves as the discharge end of the nozzle. The spout is inserted into the neck of a motorized vehicle's fuel tank during filling operations. The pressurized fuel flow through the internal fuel passage is conventionally controlled by a valve which is actuated by a manually operated valve lever selectively depressed by the nozzle user during dispensing operations.

Fuel, under pressure created by a pump, is fed through the nozzle at flow rates established by the pump capacity and the extent to which the valve lever is actuated. It has been found that the rapid flow rates capable of being generated by conventional fuel pumps feeding the nozzle produce gasoline or other fuel fumes which escape into the atmosphere. Due to the wide spread use of dispensing nozzles and the volume of fumes escaping during dispensing operations, government regulations have been passed which are designed to limit the rate of flow of fuel through the dispensing nozzle. By limiting the rate of flow, the amount of fumes escaping can be reduced to a level which is less likely to cause significant damage to the earth's atmosphere.

Accordingly, it is an object of the present invention to provide a flow rate limiting device which is mounted in a fuel dispensing nozzle and serves to limit the rate of flow of fuel through the nozzle.

It is another object of the present invention to provide a flow rate limiting device which can be readily installed in existing dispensing nozzles to place them in compliance with government regulations.

It is also an object of the present invention to provide a flow rate limiting device which can be readily manufactured and easily installed.

DISCLOSURE OF THE INVENTION

Other objects and advantages will be obvious to those skilled in the art, and will in part appear hereinafter, and be accomplished by the present invention which provides a flow rate limiting device for fuel dispensing nozzles. The flow rate limiting device is mounted in a dispensing nozzle having an inlet through which fuel is supplied to the nozzle from a supply hose, and an outlet from which fuel is discharged, as into a fuel tank of a vehicle. The nozzle further defines an internal flow passage along which the fuel flows from the inlet to the outlet of the nozzle. The flow rate limiting device comprises a turbulence generating means mounted within the nozzle in the internal flow passage. Support means are provided for mounting the turbulence generating means in the passage such that the turbulence generating means is suspended in the internal passage of the nozzle. Thusly disposed, the turbulence generating means disrupts the flow of the fuel and the resulting turbulence in the flow serves to restrict the volumetric flow of fluid so as to prevent such flow from exceeding a desired maximum flow rate.

BRIEF DESCRIPTION OF THE DRAWINGS

The above-mentioned features of the present invention will be more clearly understood by considering the following detailed description in connection with the accompanying drawings in which.

BEST MODE FOR CARRYING OUT THE INVENTION

Figure 1:
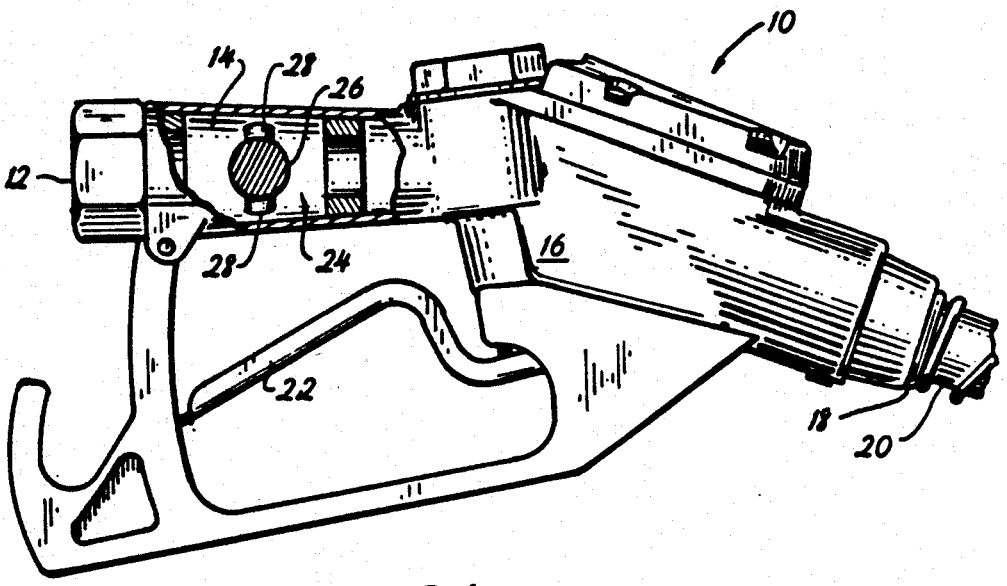
FIG. 1 is a side elevation, partially in section, of a fuel dispensing nozzle having a flow rate limiting device mounted in the internal flow passage of the nozzle.

Referring now to the figures, a fuel dispensing nozzle is illustrated at 10 in FIG. 1. The nozzle 10 includes an inlet 12 for being connected in fluid communication with a hose (not shown) which supplies pressurized fuel such as gasoline to the nozzle 10. This fuel or gasoline is pressurized by the action of a pump (not shown) mounted at a location remote from the nozzle 10. The fuel flows from the supply hose through a conventional attachment means or coupling into the inlet 12 of the nozzle 10 and enters an internal flow passage 14 within the nozzle 10. This passage 14 extends through the body 16 of the nozzle 10 and terminates at an outlet 18 which normally comprises, or is connected in fluid communication to, a discharge spout 20 through which fuel is dispensed into the fuel tank of a motorized vehicle.

As will be understood by those skilled in the art, the flow of fuel through the internal flow passage 14 is controlled in a conventional nozzle by a valve (not shown) mounted in the passage 14 within the body 16 of the nozzle 10. This valve is normally spring biased to a closed position so as to prohibit fuel flow through the passage 14, and is manually operated by a control lever 22 which can be manipulated to open the valve and allow fuel to flow through the passage 14 and the nozzle 10.

A flow rate limiting device incorporating various features of the present invention is illustrated generally at 24 in FIG. 1. The flow rate limiting device 24 serves to prevent fuel from flowing through the internal passage 14 at a rate exceeding a preselected threshold rate. This threshold rate has been established by governmental regulations at ten gallons per minute (10 GPM). Accordingly, the flow rate limiting device 24 of the present invention is designed to prevent fuel or gasoline from flowing through the fuel dispensing nozzle 10 at a rate greater than ten gallons per minute.

The flow rate limiting device 24 includes a turbulence generating means 26 mounted in the passage 14. A suitable support means is provided for mounting the turbulence generating means 26 in the passage 14 such as the radially disposed supporting arms 28. In the preferred illustrated embodiment of FIG. 1, the turbulence generating means defines a spherical member; but as illustrated at 24' in FIGS. 2A and 2B, and at 24'' in FIGS. 4A and 4B, the turbulence generating means can define conical configurations or other geometric configurations. Further, the turbulence generating means 26 is preferably suspended in the fluid path in such a manner as to permit the fuel to flow more or less uniformly about the turbulence generating means.

Figure 3A:
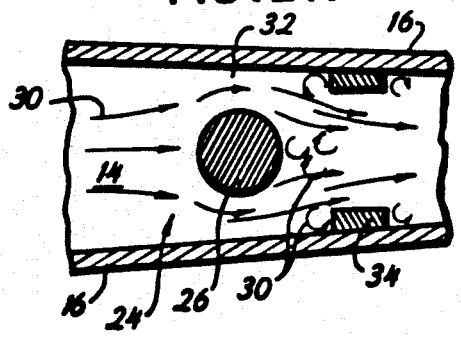
FIGS. 3A and 3B are diagrammatic illustrations of a flow rate limiting device of the present invention depicting fuel flow adjacent the limiting device.
Figure 3B:
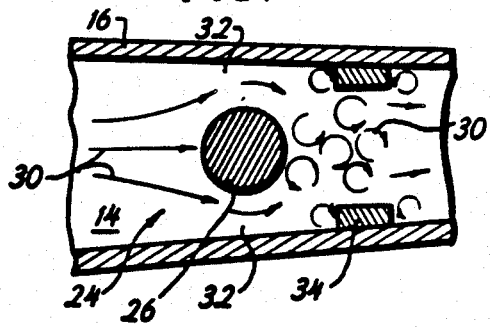

It will be noted that the embodiment of the flow rate limiting device 24 of FIG. 1 is diagrammatically illustrated in FIGS. 3A and 3B with the direction and pattern of fuel flow within the passage 14 being schematically depicted by the arrows 30. Referring to FIG. 3A, during operation of the nozzle 10 fuel enters the inlet 12 and travels down the passage 14 until it encounters the turbulence generating means 26. Flow accelerates to a maximum rate at the constrictive point 32 as flow is diverted around the means 26. However, as illustrated, due to the unstreamlined configuration of the means 26, turbulence is created immediately downstream of the turbulence generating means 26 resulting in a reduced passage cross-section and lower volumetric flow. Of course, the turbulence dissipates as the flow moves downstream from the turbulence generating means 26 such that operation of the nozzle 10 is not adversely affected. It will also be noted that if flow volume reduction is desired, a constricting ring 34 can be mounted in the passage 14 downstream from the means 26. As illustrated, the ring 34 both increases the turbulence created downstream from the means 26 and reduces the cross-sectional area of the passage 14 thereby further reducing the volumetric flow.

In FIG. 3B the flow rate limiting device 24 is depicted under circumstances where the fuel flow rate upstream from the turbulence generating means 26 is greater than is depicted in FIG. 3A, thereby illustrating circumstances where fuel flow approaches the threshold flow rate. As illustrated in FIG. 3B, the increased flow rate upstream from the device 24 creates greater turbulence, and a pressure loss increase, downstream resulting in a proportionately greater flow decrease downstream than that achieved given lesser upstream flow rates. In this regard, as the fuel stream accelerates past the constrictive point 32 the flow becomes less stable, producing significantly increased molecular flow collison causing lost energy in the flow and ultimately resulting in lower useful flow momentum. 0f course, it will be recognized that the reduction of downstream volumetric flow results in a reduction of volumetric flow upstream such that equilibrium of flow along the length of the passage 14 is achieved, and with upstream flow volume reduced, less turbulence is generated and a stable flow is achieved.

Figure 2A:
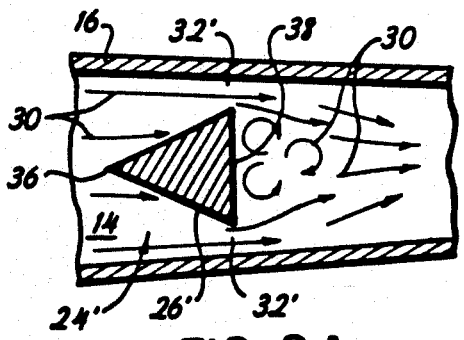
FIGS. 2A and 2B are diagrammatic illustrations of an alternate embodiment of a flow rate limiting device of the present invention depicting fuel flow adjacent the limiting device.
Figure 2B:
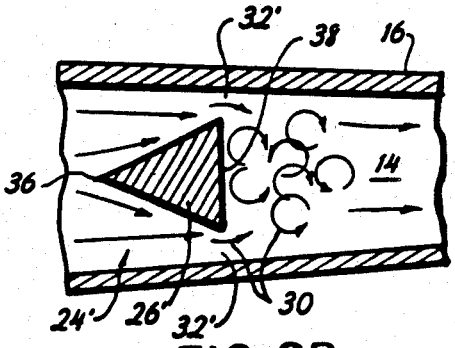

In FIGS. 2A and 2B, an alternate embodiment of the flow rate limiting device of the present invention is illustrated at 24'. In this alternate embodiment, the turbulence generating means 26' defines a conical member coaxially oriented within the passage 14 of the nozzle 10 with the vertex 36 of the cone directed upstream into the fuel flow. It will be appreciated by those skilled in the art that, as described with respect to the embodiment of FIG. 1, flow accelerates to a maximum rate at the constrictive point 32' as flow is diverted around the conical member 26'. However, fluid pressure drops and turbulence is generated immediately downstream of the planar base 38 of the conical member 26' lowering the volumetric flow. Further, as in the case of the device 24 described above, as the upstream flow rate is increased, the amount of turbulence increases, and, thus, greater deceleration of flow is achieved as is illustrated by a comparison of FIG. 2A, which depicts a relatively slow upstream flow, and FIG. 2B, which depicts a relatively fast upstream flow rate.

Figure 4A:
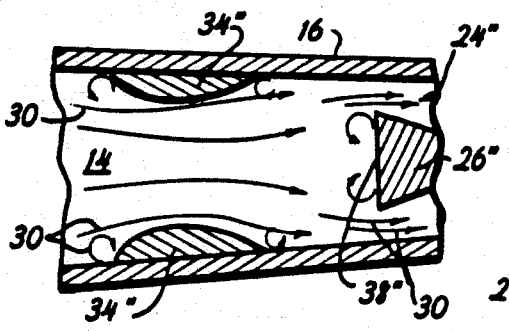
FIGS. 4A and 4B are diagrammatic illustrations of a flow rate limiting device of the present invention depicting fuel flow adjacent the limiting device.
Figure 4B:
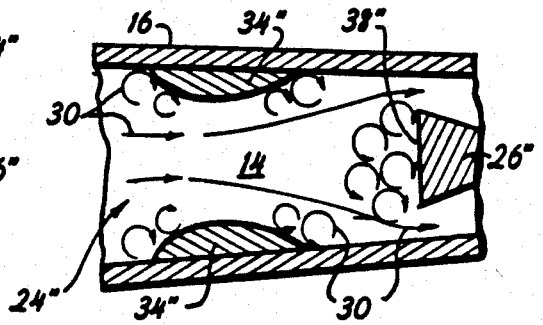

A further embodiment of a flow rate limiting device of the present invention is illustrated at 24'' in FIGS. 4A and 4B, the FIG. 4A depicting a slow upstream flow rate and FIG. 4B illustrating a relatively fast upstream flow rate. In the embodiment of FIGS. 4A and 4B, the turbulence generating means 26'' comprises, a conical member, but in this embodiment the planar base 38'' of the conical member 26'' is directed upstream so as to intercept the oncoming fuel flow. Further, the device 24'' includes a constrictive ring 34'' positioned in the passage way 14 upstream from the conical member 26'' which serves to reduce the flow cross-sectional area of the passage 14. As fuel passes through the ring 34'', flow accelerates and is directed against the base 38'' of the conical member 26'' resulting in flow volume reducing turbulence. As the upstream flow rate increases, the increased momentum of flow through the ring 34'' allows less of the flow to divert around the conical turbulence generating means 26'' and the turbulence upstream from the turbulence generating means increases resulting in reduced flow volume.

Figure 5A:
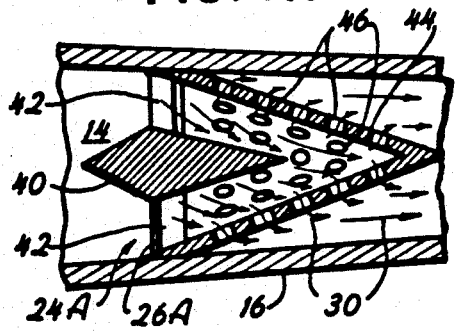
FIGS. 5A and 5B are diagrammatic illustrations of a flow rate limiting device of the present invention depicting fuel flow adjacent the limiting device.
Figure 5B:
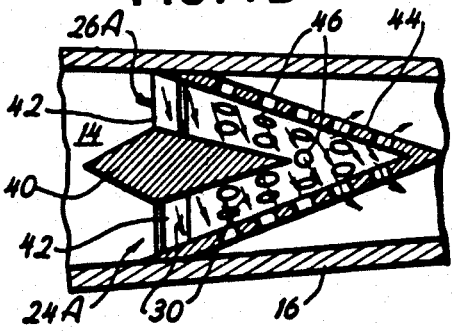
Figure 6A:
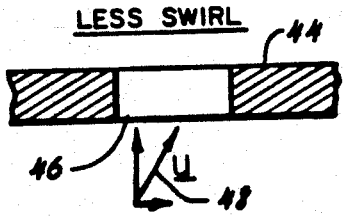
FIGS. 6A and 6B are diagrammatic front elevations, in section, of a portion of the perforated screen of an alternate embodiment of a flow rate limiting device of the present invention.
Figure 6B:
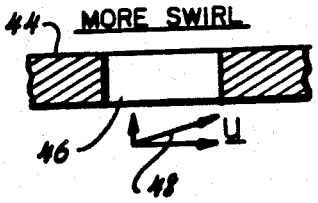

Yet another embodiment of a flow rate limiting device of the present invention is illustrated at 24A in FIGS. 5A and 5B. In this embodiment, the turbulence generating means 26A comprises a plurality of holes 46 transversely disposed in the peripheral wall of a conical chamber 44 through which liquid may flow at rates below the preselected threshold rate. The wall of the chamber 44 is located in interrupting relationship with the fluid passage downstream from a series of vortex generating vanes 42, the vanes 42 being supported by and extending radially from an axially disposed streamlined junction member 40. As illustrated in FIGS. 5A and 5B the apex or downstream end of the chamber 44 has no holes so that the fuel may flow only transversely through the holes 46 when leaving the chamber 44. As the means 26A intercepts the fuel flow within the passage 14, the vanes 42 generate turbulence in the form of a vortex within the chamber 44 thereby increasing flow resistance and resultantly lower volume fuel flow downstream from the means 26A. As illustrated in FIG. 5B, an increase in upstream flow rate results in a more extreme vortical spiral and a greater angular deviation of useful flow vectors from the axis of the passage 14, thereby causing lower volume downstream flow. As illustrated in FIG. 6A, when the upstream flow rate is relatively slow, the turbulence vectors, illustrated at 48, of the vortical flow 48 tend to approach the perforations 46 at a lesser angle than where the upstream flow rate is relatively fast as illustrated in FIG. 6B due to the looser spiral of the vortical flow generated when upstream flow rates are low. As the flow rate through the fluid passage approaches the preselected threshold rate, the cyclonic velocity, combined with the velocity of the liquid flowing along the passage causes the resultant direction of the flow 48 in FIGS. 6A and 6B to approach the holes 46 in the chamber wall 44 at such an angle as to significantly obstruct flow through the holes 46. This reduces the flow rate in a self-correcting manner. Therefore, at higher upstream flow rates, the screen 44 tends to be more disruptive of volumetric flow such that a lower overall flow is achieved.

In light of the above, it will be appreciated that the flow rate limiting device of the present invention serves to lower the volumetric fuel flow through a fuel dispensing nozzle and provides for lower flow where input flow rate is increased such that lower flow rates are achieved. Moreover, predictable flow rates below the maximum legal flow rate can be maintained by preselecting a turbulence generating means of sufficient sizes and of appropriate configuration to generate sufficient turbulence to insure that appropriate flow reduction results.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. A fuel dispensing nozzle having an inlet through which liquid fuel is supplied from a supply hose within a range of supply inlet pressures, an outlet from which fuel is discharged, an internal flow passage through which fuel may flow from the inlet to the outlet, valve means disposed within said fuel passage intermediate said inlet and said outlet for selectively opening communication between said inlet and said outlet to permit fuel to flow from said inlet to said outlet, and flow rate limiting means, said flow rate limiting means including a turbulence generating body member disposed in said passage intermediate said inlet and said valve means for limiting the volumetric rate of fuel flowing through said nozzle to a predetermined maximum rate independent of the fuel inlet pressure within said range and independent of the amount of communication provided between said inlet and said outlet by said valve means.

2. The nozzle of claim 1 wherein said flow rate limiting means further comprises means for supporting said body member in a suspended position within said internal flow passage.

3. The nozzle of claim 2 wherein said turbulence generating body member defines a substantially spherical member.

4. The nozzle of claim 3 wherein said support means comprises a plurality of support arms extending radially from said spherical member.

5. The nozzle of claim 2 wherein said turbulence generating body member defines a substantially conical member substantially coaxially aligned within said passage.

6. The nozzle of claim 5 wherein said support means comprises a plurality of supporting arms extending radially from said conical member.

7. The nozzle of claim 5 wherein said conical member defines a vertex oriented toward said fuel flow from said inlet.

8. The nozzle of claim 5 wherein said conical member defines a planar base oriented toward said fuel flow from said inlet.

9. The nozzle device of claim 3 wherein said flow rate limiting means further comprises an area constricting ring of finite width mounted within said passage proximate said spherical member, said ring being disposed between said spherical member and said valve means for reducing the cross-sectional area of said passage relative to the area of said passage adjacent said ring and for increasing the turbulence generated in said fuel flow between said inlet and said valve means.

10. The nozzle of claim 8 wherein said flow rate limiting means further comprises an area constricting ring of finite width mounted within said passage proximate said concial member, said ring being disposed between said conical member and said inlet, for reducing the cross-sectional area of said passage relative to the areas of said passage adjacent said ring and for directing said fuel flow toward said planar base of said conical member.

11. The nozzle of claim 1, wherein said turbulence generating body member comprises a centrally disposed conical member having an apex directed toward said valve means and carrying a plurality of radially disposed vanes for intercepting said fuel flow and generating turbulence in the form of a vortex, and a perforated conical chamber disposed about said conical member within said passage between said vanes and said valve means, said chamber having a plurality of peripheral holes and an apex directed toward said valve means, said apex having no holes so that fuel is directed over said conical member in the space between said conical member and said chamber for reducing the flow to said valve means to said predetermined maximum rate.

12. A fuel dispensing nozzle having an inlet through which fuel is supplied from a supply hose within a range of supply inlet pressures and an outlet from which said fuel is discharged, an internal flow passage within said nozzle through which said fuel flows from said inlet to said outlet, valve means disposed in said passage intermediate said inlet and said outlet for selectively opening communication between said inlet and said outlet, and flow rate limiting means for providing a non-linear reduction in the flow of fuel through said nozzle for maintaining the rate of fuel flow below a preselected maximum flow rate, said limiting means comprising a turbulence generating body member mounted within said internal flow passage intermediate said inlet and said valve means for generating a turbulence in said fuel flow, said turbulence generating body member comprising a substantially spherical member, support means for supporting said spherical member in a suspended position within said passage, and an area constricting ring mounted within said passage intermediate said spherical member and said valve means for reducing the cross-sectional area of said passage and for further increasing the turbulence generated in said fuel flow for limiting the volumetric rate of fuel flowing through said nozzle to said predetermined maximum rate independent of the fuel inlet pressure within said range and independent of the amount of communication provided between said inlet and said outlet by said valve means.

* * * * *